United States Patent [19]

Clarkson et al.

[11] 4,122,684

[45] Oct. 31, 1978

[54] METHOD FOR THE RECOVERY OF VOLATILE LIQUIDS

[75] Inventors: Michael J. Clarkson, Penmark; Robert Duffield, Penarth, both of Wales

[73] Assignee: BP Chemicals Limited, London, England

[21] Appl. No.: 700,556

[22] Filed: Jun. 28, 1976

[30] Foreign Application Priority Data

Jul. 23, 1975 [GB] United Kingdom ..... 30793/75

[51] Int. Cl.[2] ..... F17C 7/02

[52] U.S. Cl. ..... 62/54; 55/93; 220/85 VR

[58] Field of Search ..... 62/54, 55, 434; 55/269, 55/80, 82, 93; 220/85 VR

[56] References Cited

U.S. PATENT DOCUMENTS

| | | | |
|---|---|---|---|
| 2,388,160 | 10/1935 | Krase | 55/80 |
| 3,320,756 | 5/1967 | Hashemi | 62/54 |
| 3,324,670 | 6/1967 | Vankleef | 62/54 |
| 3,535,210 | 10/1970 | Linde et al. | 62/333 |

*Primary Examiner*—Ronald C. Capossela

*Attorney, Agent, or Firm*—Brooks, Haidt, Haffner & Delahunty

[57] ABSTRACT

Condensing of low boiling material from a gas by contact with heat exchange surface cooled with a boiling intermediate refrigerant which is itself condensed by boiling cryogenic fluid passing from a source to a sink of cryogenic fluid.

10 Claims, 2 Drawing Figures

METHOD FOR THE RECOVERY OF VOLATILE LIQUIDS

The present invention relates to the removal of low boiling liquids from gas streams.

In many chemical manufacturing operations it is necessary to remove low boiling substances present in the form of vapours in gas streams. The low boiling substances may for example be a pollutant which it is desired to remove from the gas stream. Various methods are known for removing such vapours of low boiling substances for example adsorption with activated carbon. This method has the disadvantage that the carbon requires regeneration at intervals and may suffer an irreversible loss of activity with time. It is of course possible to condense the vapour from the gas stream. It is difficult to achieve satisfactory removal of vapours of substances having appreciable vapour pressures at temperatures below those which can be achieved by conventional refrigeration apparatus based on for example ammonia as the working fluid.

The construction and operation of closed cycle refrigeration apparatus with compressors at low temperatures presents considerable mechanical problems.

At many chemical works bulk supplies of liquid air, liquid oxygen, or liquid nitrogen are available because the gases are used in chemical manufacturing processes at the works. These supplies of bulk liquid air or its constituents are produced by specialist producers who possess special skills in the operation and design of cryogenic apparatus. It would seem that the problem of operating cryogenic apparatus at individual chemical works could be overcome by using the supplies of bulk liquid gases to condense out the vapours of low boiling substances from gas streams. However many vapours which it is desired to condense out of gas streams freeze at a temperature which is above the highest conveniently attainable by these bulk liquid gases. Now it is much more convenient to condense out a vapour as a liquid than as a solid, as liquid condensing on a surface can be readily collected from it while if the vapour freezes on a surface it is necessary to interrupt the process at intervals to allow the frozen material to melt so that it can run off.

Gaseous effluent streams containing vinyl chloride are often produced at plants producing vinyl chloride or polyvinyl chloride. Health hazards have been associated with exposure to vinyl chloride and it is highly desirable to reduce the amount of vinyl chloride released to the atmosphere to as low a value as possible. Unfortunately vinyl chloride freezes at a temperature which is above the maximum temperature which can be conveniently obtained by boiling liquid air, oxygen or nitrogen so the use of these liquid gases does not seem a very suitable method of removing vinyl chloride from gaseous effluents.

According to the present invention the process for the recovery of a low boiling material, present as a vapour in a gas, comprises feeding a bulk cryogenic fluid from a source of liquid cryogenic fluid to a sink of gaseous cryogenic fluid across a first heat exchange surface through which heat is removed from liquid intermediate refrigerant condensing on the other side of the first heat exchange surface, the condensed liquid intermediate refrigerant then passing to a second heat exchange surface, through which it removes heat into boiling liquid intermediate refrigerant from low boiling material, present as a vapour in a gas, condensing as a liquid on the other side of the second heat exchange surface.

Throughout this specification "bulk cryogenic fluid" means air, oxygen and nitrogen. These are readily available in large quantities in liquid form.

The process requires that the intermediate refrigerant should be condensed as a liquid by the boiling cryogenic liquid and should also boil at a temperature which condenses liquid low boiling material. The best intermediate refrigerant in any case will depend upon the freezing and boiling points of the material to be condensed from the gas as well as on the boiling temperature of the cryogenic liquid which will in turn depend on the pressure at which the boiling cryogenic fluid is maintained. Furthermore the pressures required to obtain the necessary temperatures should not be excessively high. Examples of intermediate refrigerants which may be used are methane, propane, propylene, argon. It is preferred to use methane for the recovery of vinyl chloride.

The gas containing the vapour of low boiling material which condenses out as a liquid may also contain vapour of low boiling material which condenses out as a solid under the same conditions. The solid may be removed at intervals by melting, and as long as there is present in the gas a substantial amount of material which condenses out as a liquid rather than a solid the process of the present invention will be advantageous by comparison with direct condensation as a solid by direct use of boiling bulk cryogenic fluid.

The process of the present invention may be applied to the recovery of materials freezing at temperatures produced by boiling cryogenic fluid e.g. above −180° C. and which boil below −50° C.

Heat loss from the zones where heat exchange is taking place is reduced by suitable insulation and it is preferred to carry out all the heat exchange within a common insulated shell.

The process requires that the bulk cryogenic fluid passes from a source of bulk liquid cryogenic fluid, which may be an insulated tank of liquid cryogenic fluid, to a sink of gaseous cryogenic fluid, which may for example be the atmosphere or a chemical manufacturing process.

In respect of the cryogenic fluid the process of the invention is a single pass process to be distinguished from a closed cycle refrigeration process which reconverts gaseous cryogenic fluid to liquid cryogenic fluid for re-use in the process by the use of elaborate machinery. The gaseous cryogenic fluid produced in the process of the invention is available for use elsewhere if desired.

The present invention may be applied, for example, to gas streams containing 0.5% to 50% of vinyl chloride. The gas stream used is preferably dry, that is it does not contain any substantial quantity of water as this would freeze as a solid layer on the heat exchange surfaces, and would have to be removed at intervals. The total amount of freezable materials in the gas stream i.e. materials which are solid at the temperatures used to condense the vinyl chloride, for example carbon dioxide and water, is preferably not more than 10% by weight of the vinyl chloride. Where minor amounts of freezable materials are present in the gas stream it may be necessary to use duplicate apparatus, one of which is used to condense vinyl chloride while the other is allowed to heat up to melt the freezable material so that it can be removed.

The pressure and temperature of the gas stream containing vinyl chloride fed to the process of the present invention may vary over a moderately wide range, for example the pressure may be 0 to 80 psig and the temperature may be 20 to −60° C. In order to reduce the heat load on the liquid nitrogen refrigerant it is desirable to use a gas stream which has been subjected to some degree of cooling before it is fed to the process of this invention, for example using a standard liquid ammonia refrigerating system. Where the process of the present invention is applied to the gaseous effluent from a primary stage of monomer recovery, it may already be at a reduced temperature e.g. −20° to −50° C.

It is an important feature of the present invention that all the heat exchange required to transfer heat from the incoming gas by way of the intermediate refrigerant to the liquid cryogenic fluid may take place within a common insulated shell so that the amount of heat leaking into the system is reduced to the minimum.

An example of a suitable apparatus for use in the process of the invention comprises an insulated shell divided into an uppermost, a middle and lower most compartment, the uppermost compartment being in heat exchange contact with the middle compartment through an upper heat exchange surface, and the middle compartment being in heat exchange contact with the lower most compartment through a lower heat exchange surface, the uppermost compartment being provided with an inlet for introducing liquid on to the upper heat exchange surface, and an outlet for removing gas from the compartment, the lower most compartment being provided with an inlet for introducing gas into contact with the lower heat exchange surface, an outlet for removing gas after it has been brought into contact with the heat exchange surface, and an outlet for removing liquid which condenses on the lower heat exchange surface, the middle compartment being provided with a gas inlet, the upper and lower heat exchange surfaces being so disposed that liquid introduced by the inlet into the uppermost compartment is distributed over the upper heat exchange surface and liquid condensing in the upper heat exchange surface is distributed over the lower heat exchange surface.

The heat exchange surfaces may be composed of sets of tubes disposed within the insulated shell. It is particularly preferred to use upper and lower heat exchange surfaces each consisting of a set of vertical tubes of the well-known bayonet type. Bayonet type heat exchange tubes consist of two tubes one within the other. The outer tube is closed at one end. Heat exchange medium is passed along the inner tube towards the closed end of the outer tube and leaving the open end of the inner tube passes back through the outer tube countercurrent to the flow in the inner tube. If bayonet heat exchange tubes are used it will be necessary to arrange for the inner tubes to be fed with liquid and for the outer tubes to open into a gas space. This may be achieved by dividing a compartment into which a bayonet tube opens into an upper and lower sub-compartment, the inner tubes of the bayonet tubes opening into the base of the upper sub-compartment, the outer tubes opening into the lower sub-compartment, and the upper and lower sub-compartments within each compartment communicating only by a passage from the lower sub-compartment opening above the base of the upper sub-compartment.

The invention will now be described with reference to the accompanying drawings.

Figure 1:
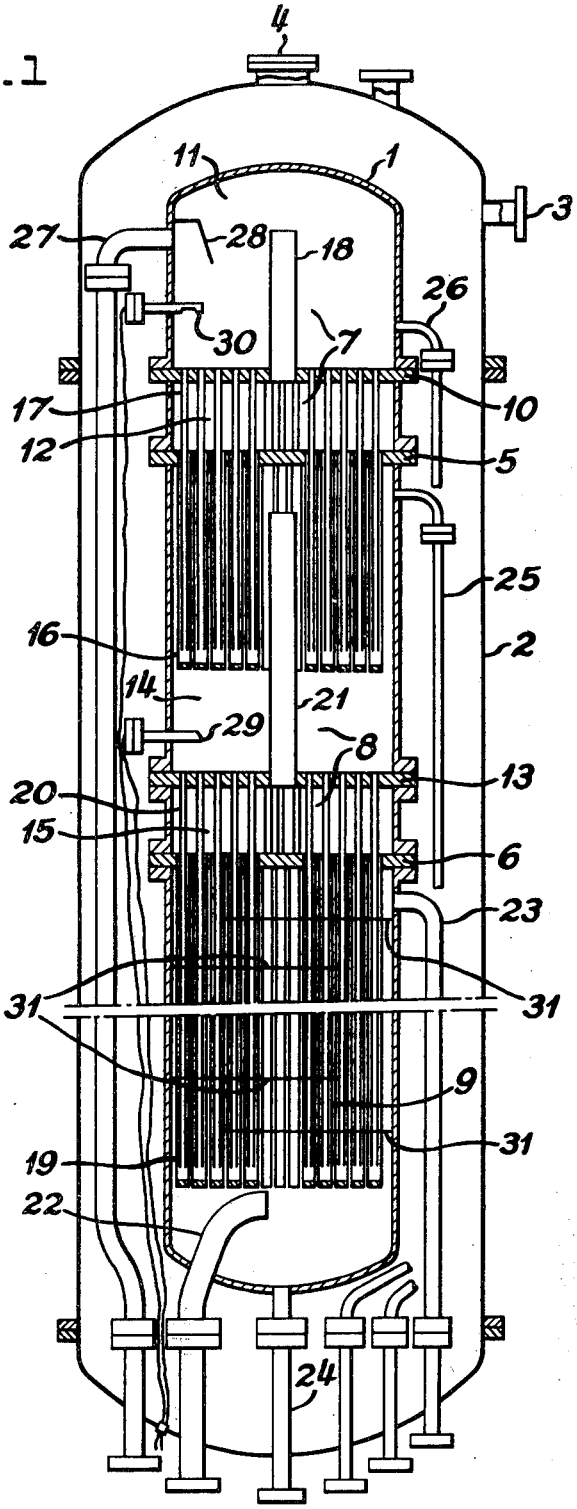
FIG. 1 is a sectional view of the apparatus used, along its length with a portion of the lower part of the apparatus between the two transverse lines omitted to save space in the drawing.

The apparatus comprises a shell 1 surrounded by a jacket 2. The space between the shell 1 and jacket 2 may be evacuated through opening 3 to insulate the shell 1. Expanded insulated material e.g. Perlite may be introduced into the space between the jacket 2 and shell 1 through a manhole 4. The space within shell 1 is divided by horizontal plates 5 and 6 into an upper compartment 7, a middle compartment 8, and a lower compartment 9. The upper compartment 7 is divided by plate 10 into an upper sub-compartment 11 and a lower sub-compartment 12. The middle compartment 8 is similarly divided by plate 13 into an upper sub-compartment 14 and a lower sub-compartment 15. A plurality of tubes 16, closed at their lower ends and extending into sub-compartment 14 of compartment 8, open at their upper ends into sub-compartment 12. A plurality of tubes 17 open into sub-compartment 11 and extend downwardly through sub-compartment 12 into the tubes 16. The tubes 17 are open at their lower ends. Sub-compartment 12 communicates with sub-compartment 11 through a pipe 18 extending upwardly from plate 10.

The tubes 19 extend from plate 6 into compartment 9 and tubes 20 extend from plate 13 into tubes 19 in an arrangement corresponding to that for tubes 16 and 17. A pipe 21 extends upwardly from plate 13 and opens into sub-compartment 14 close to plate 5 so providing communication between sub-compartment 14 and 15.

Pipe 22 opens into compartment 9 close to the lower ends of the tubes 19. Pipe 23 opens into compartment 9 close to the base of plate 6. A pipe 24 communicates with the base of compartment 9. Pipe 25 communicates with compartment 8 at a point close to the base of plate 5. Pipe 26 opens into sub-compartment 11 of compartment 7 a little way above plate 10. Pipe 27 opens into sub-compartment 11 near the top and is provided with a guard 28 to restrain carry-over of material introduced by pipe 26. A thermometer 29 measures the temperature above plate 13, and a level sensor 30 gives an electrical signal if the level of liquid in sub-compartment 11 reaches the level of the level sensor. The shell and the components within it are constructed of materials which withstand the low temperatures used at the pressures existing within the shell when the apparatus is in use. Suitable materials will be well-known to those skilled in the art. The heat exchanger tubes are made in such a thickness and of such a material to give a good rate of heat transfer. Spacers 31 are provided to maintain the alignment of the bayonet tubes.

In operation liquid nitrogen is fed through pipe 26 into sub-compartment 11 and passes down through the tubes 17 to the base of the tubes 16. The nitrogen then passes upwards in tube 16, and any heat passing through the walls of tube 16 will vapourise nitrogen. Nitrogen gas from the tubes 16 leaves sub-compartment 12 through pipe 18 and leaves the shell 1 through pipe 27. High levels of nitrogen within compartment 7 are prevented by level sensor 30, which provides a signal when it comes into contact with liquid nitrogen. This signal is used in known mechanism (not shown) to turn off the supply of liquid nitrogen until the level of liquid nitrogen falls. The liquid nitrogen is fed at controlled pressure.

Methane gas is introduced into compartment 8 through pipe 25. The methane condenses on the outside of the tubes 16 and runs down these to plate 13 from which the liquid methane runs into tubes 20 and from the tubes 20 passes up into the tubes 19. Any heat passing through the wall of tube 19 will boil the liquid methane and methane vapour from tubes 19 will pass up through tube 21 where it will be cooled by the tubes 16 and condense. Methane is not consumed in the process but the methane filled compartment 8 is in communication with a large reservoir of methane gas to reduce the effect on the gas pressure of methane of the condensation or evaporation of liquid methane within the column.

In an example of how the invention may be carried out in practice air at a pressure of 50 psig. (246kN/M$^2$ absolute) and a temperature of −45° C. and containing 56 parts by weight of vinyl chloride and 5 parts by weight of carbon dioxide for every 165 parts of air may be used. This air supply may be obtained from a primary monomer recovery step. This air is fed in through pipe 22 and is withdrawn through pipe 23. Vinyl chloride condenses on the tubes 19 and collects at the base of compartment 9 from which it is run off through pipe 24. Carbon dioxide freezes on the tubes 19.

The process is controlled so as to maintain the desired temperatures within the shell 1. Thus the temperature of tubes 19 must be maintained above the freezing point but below the boiling point of vinyl chloride under the conditions existing in compartment 9. Similarly the temperatures of tubes 16 must be maintained above the freezing point but below the boiling point of methane under the pressure prevailing in compartment. As indicated above the temperature of the liquid nitrogen is controlled by controlling the pressure at which it is supplied to compartment 7. Thus the pressure within the compartment 9 may be maintained at 160 psig. (1204.5kN/M$^2$absolute) corresponding to a temperature of −165° C.

The pressure in compartment 8 is not fixed and will depend upon the amount of methane which has condensed to liquid. As more methane condenses the pressure will fall and the boiling temperature of the methane will also fall. The temperature of the methane is measured by thermometer 29 and when a pre-set minimum value (above the freezing point of vinyl chloride) is reached an electronic circuit (not shown) of a type well-known to those skilled in the art controls the rate at which nitrogen is fed to compartment 7 so as to prevent any further accumulation of liquid methane in compartment 8 leading to a further drop in pressure and so of temperature.

Figure 2:
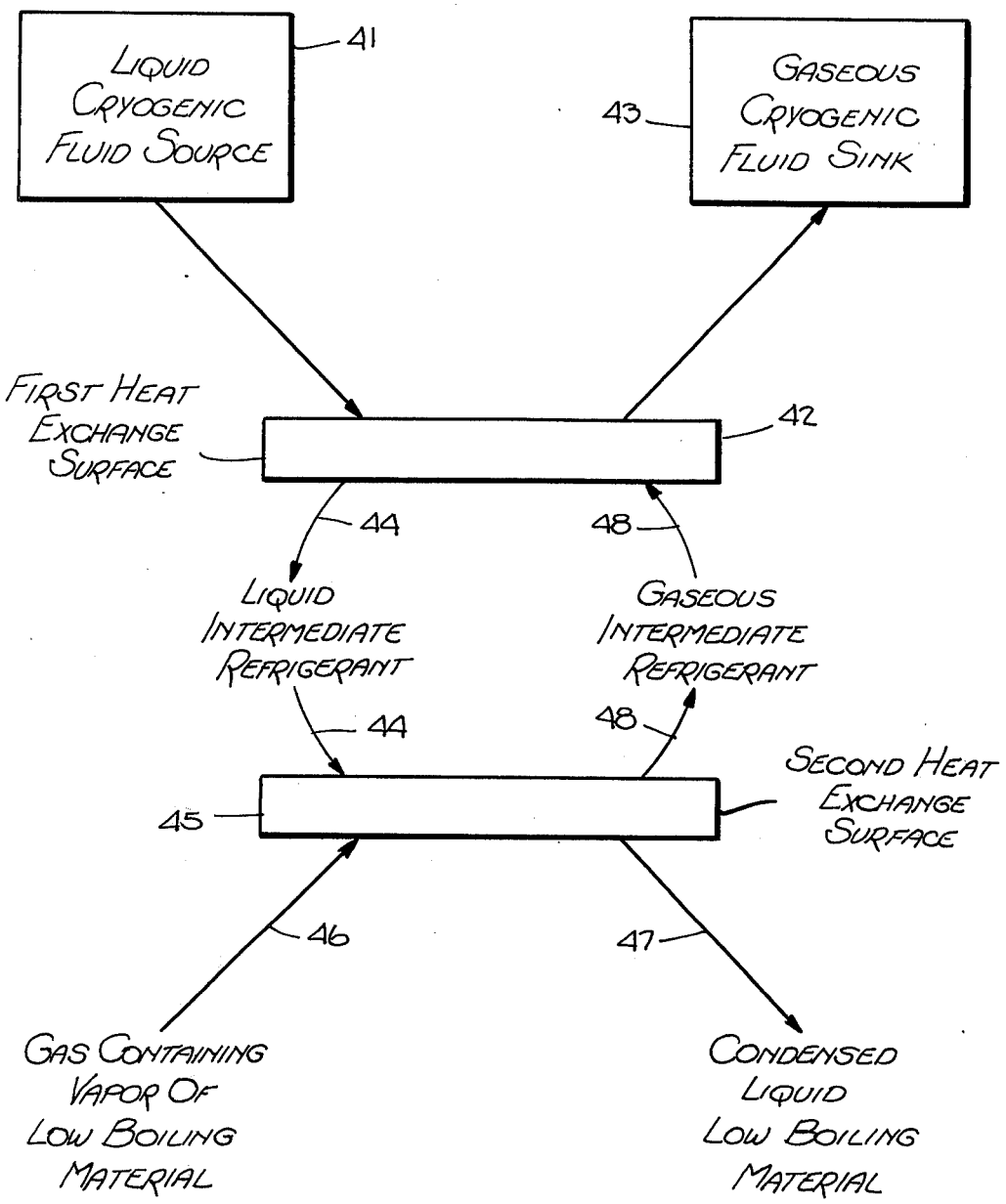
FIG. 2 is a schematic drawing illustrating the process of the invention.

As shown in FIG. 2, liquid bulk cryogenic fluid is fed from a source 41 of liquid cryogenic fluid into contact with the first side of a heat exchanger surface 42 where it boils to produce gaseous cryogenic fluid which passes to a sink of gaseous cryogenic fluid 43. Liquid intermediate refrigerant 44 which has condensed on the second side of the first heat exchanger, giving up its heat to the cryogenic fluid, passes without compression into contact with the first side of a second heat exchanger 45 through which it removes heat into boiling liquid intermediate refrigerant from low boiling materials present as a vapour in a gas 46. The vapour of the low boiling materials condenses to a liquid 47 on the second side of the second heat exchange surface 45. The gaseous intermediate refrigerant 48 produced by the boiling of the liquid intermediate refrigerant passes into contact with the second side of the first heat exchanger 42 where it condenses.

We claim:

1. The process for the recovery of a low boiling material present as a vapour in a gas which comprises feeding a bulk cryogenic fluid from a source of liquid cryogenic fluid to a sink of gaseous cryogenic fluid across the first side of a first heat exchange surface through which heat is removed from liquid intermediate refrigerant condensing on the second side of the first heat exchange surface, then passing the condensed liquid intermediate refrigerant, without compressing said refrigerant, to the first side of the second heat exchange surface through which it removes heat into boiling liquid intermediate refrigerant from low boiling materials present as a vapour in a gas, which vapour is condensing as a liquid on the second side of the second heat exchange surface.

2. The process according to claim 1 wherein the intermediate refrigerant is selected from the group consisting of methane, propane, propylene and argon.

3. The process according to claim 1 wherein the low boiling material is vinyl chloride which is present in a stream of gas fed into contact with the second heat exchanger.

4. The process according to claim 3 wherein the gas is air.

5. The process according to claim 4 wherein the intermediate refrigerant is methane.

6. The process according to claim 5 wherein the gas stream is dry.

7. The process according to claim 1 wherein the total amount of freezable materials present in the gas stream is not more than 10% by weight of the vinyl chloride.

8. The process according to claim 1 wherein the pressure of the gas stream is in the range 0 to 80 psig.

9. The process according to claim 1 wherein the temperature of the gas stream is 20° to −60° C.

10. The process according to claim 1 wherein all the heat exchange required to transfer heat from the gas containing the low boiling substance by way of the intermediate refrigerant to the liquid cryogenic fluid takes place within a common insulated shell.

* * * * *